US006307207B1

(12) United States Patent
Burbank

(10) Patent No.: US 6,307,207 B1
(45) Date of Patent: Oct. 23, 2001

(54) PHOTOLUMINESCENT EMERGENCY EGRESS PATHWAY MARKING SYSTEM

(75) Inventor: Robert M. Burbank, Lebanon, NH (US)

(73) Assignee: Astronics Corporation, Buffalo, NY (US)

( * ) Notice: Subject to any disclaimer, the term of this patent is extended or adjusted under 35 U.S.C. 154(b) by 0 days.

(21) Appl. No.: 09/470,233

(22) Filed: Dec. 22, 1999

(51) Int. Cl.[7] ..... E04F 19/04
(52) U.S. Cl. ..... 250/462.1; 340/332; 442/76
(58) Field of Search ..... 250/462.1; 340/332; 442/76

(56) References Cited

U.S. PATENT DOCUMENTS 2,169,657 8/1939 Millson .
4,029,994 6/1977 Iwans .
4,211,813 * 7/1980 Gravisse et al. ..... 442/76
5,300,783 * 4/1994 Spencer et al. ..... 250/462.1
5,424,006 6/1995 Murayama et al. .
5,637,378 6/1997 Hensler .
5,661,374 8/1997 Cassidy et al. .
5,674,437 10/1997 Geisel .
5,724,909 3/1998 Pitman et al. .
5,904,017 * 5/1999 Glatz et al. ..... 250/462.1
5,914,076 6/1999 Schloss .

* cited by examiner

*Primary Examiner*—Constantine Hannaher
*Assistant Examiner*—Andrew Israel
(74) *Attorney, Agent, or Firm*—Steven J. Hultquist

(57) ABSTRACT

An emergency egress system for a locus that is exposed to light in non-emergency use and susceptible to interruption or termination of light in emergency circumstances. The emergency egress system comprises a fibrous web deployed in the locus, wherein the fibrous web has photoluminescent fiber incorporated therein in sufficient amount and distribution to illuminate the web or predetermined portions thereof during the interruption or termination of light in emergency circumstances, and subsequent to light exposure thereof.

19 Claims, 5 Drawing Sheets

PHOTOLUMINESCENT EMERGENCY EGRESS PATHWAY MARKING SYSTEM

FIELD OF INVENTION

The present invention generally relates to an unpowered photoluminescent emergency egress marking system having utility for demarcation of egress route(s) from a structure such as a building, vehicle, aircraft, train, ships, etc. More particularly, the present invention relates to a carpet containing photoluminescent fibers woven therein, providing essentially uniform luminescence across the surface area of the emergency egress path and/or across informational icons formed therein.

BRIEF DESCRIPTION OF THE RELATED ART

All aircraft, as well as many other common carriers and buildings, are required to have backup lighting systems which demarcate emergency egress paths. Such systems assist passengers in locating and moving to exits during an emergency. Emergency egress pathway marking systems are broadly classified as "active" or "passive," the former requiring a source of electrical or other power to provide illumination, and the latter providing illumination with no electrical or other power source.

Active emergency egress pathway marking systems and componentry are well known in the art. Cassidy, et al. U.S. Pat. No. 5,661,374 discloses serial/parallel configuration and constant current power supply circuitry for modular lighting strips using LED's, electroluminescent elements, or incandescent bulbs as active illuminating elements. Iwans U.S. Pat. No. 4,029,994 describes the use of flashing strobe type lights to demarcate emergency egress pathways, and to lead passengers in a proper direction along a pathway by creating the effect of light beams moving along the markers toward the emergency exits.

Active emergency egress pathway marking systems suffer a variety of drawbacks, particularly as applied to aircraft. Since the primary purpose of the systems is to provide active illumination during emergency, such as following a crash or after single or multiple aircraft system failures, these systems require a separate, independent, redundant power source—typically emergency batteries.

Thus, the active marking system, and its accompanying power source and distribution wiring, comprise an independent aircraft system with its own inspection, testing, and maintenance requirements. Further, in a severe crash involving significant structural damage, the marking lighting elements, their power supply wiring, and/or the batteries could be severed from the relevant portion of the craft or otherwise sustain damage impairing the function or operability of the system or its components. This may result in failure of the system to fully illuminate under the very circumstances in which its proper operation is most critical.

Active system designs may include various redundancies to increase their reliability, but this also increases costs, complexity, and maintenance requirements.

Active emergency egress pathway marking systems may be enhanced or even replaced by passive systems. Since passive systems require no electrical power source or power distribution wiring, they are less complex; more easily installed, replaced, and modified; as a result, and in contrast to active systems, such passive systems may be substantially or even totally maintenance-free. Since passive systems are never switched "on" or "off," they function whenever ambient lighting is removed or severely decreased.

Passive systems can provide emergency egress marking functionality following even severe crash damage, and "fail" in their essential function only if physically displaced by the crash or other structural damage from their fixed spatial relationship to the emergency exits.

Generally, passive emergency egress pathway marking systems utilize photoluminescent material that stores energy when exposed to certain wavelength bands present in most ambient light sources and slowly releases visible energy long after the ambient source is removed.

Photoluminescent materials are well known in the art, and include for example zinc sulfide, calcium sulfide, and alkaline earth metal type aluminate as described in Murayama et al., U.S. Pat. No. 5,424,006. The intensity of illumination provided by photoluminescent material s begins to decay immediately upon the removal of ambient light. However, human visual perception increases shortly after the removal of ambient light, as physiological adjustments occur to the eye, and individuals progress to "night vision." Thus, photoluminescent materials may provide sufficient luminous energy to an emergency egress path w ay for several hours following the removal of ambient light.

Passive emergency egress pathway marking systems utilizing photoluminescent material are well known in the art.

Pitman, et al. U.S. Pat. No. 5,724,909 discloses a strip type pathway marker using photoluminescent material, comprising a base element mounted to e.g. a floor, wall, or stair riser, and a separate photoluminescent source releasably attached thereto. Pitman discloses the use of these photoluminescent s trips to demarcate the outlines and intersections of building structures, such as walls, stairs, etc.

It is known in the art to use photoluminescent strip lighting to demarcate exit paths in aircraft. The photoluminescent strips are typically mounted at or near the floor of the aisle in parallel spaced relationship, and extend longitudinally along the aisle toward the exit, defining a path between the two strips, for passenger egress.

While the use of photoluminescent strips to demarcate structures and define pathways overcomes many of the disadvantages associated with active emergency egress pathway marking systems, the photoluminescent strip systems themselves have several inherent disadvantages.

Photoluminescent strips rely on ambient lighting to be activated. In certain environments the locations of the ambient light sources are not conducive to optimum exposure of the photoluminescent strips. As the strips form the outline of the pathway, their location is essentially fixed. The ambient light sources therefore need to be positioned to adequately illuminate the strips within a desired minimum exposure duration. Also, moveable items such as suitcases, briefcases, etc. may block the activation of the strips in localized areas and eliminate the continuous marking required of strips.

The luminance intensity, or brightness, of photoluminescent strips is considerably lower than that of active lighting technologies, i.e., LEDs, electroluminescent lamps, or incandescent lighting elements.

Additionally, as discussed above, the luminous intensity of photoluminescent material decreases rapidly following the removal of ambient light. Accordingly, particularly in a smoke-filled environment, parallel photoluminescent strips may be less visible and hence less effective in guiding passengers to the exit than would a more conspicuous passive egress pathway marking configuration.

Furthermore, any directional or other informational indicators formed in photoluminescent strips, such as arrows, pictograms, or text, would necessarily be of a small size and therefore of marginal effectiveness for communicating information to passengers during an emergency.

Accordingly, it is an object of the present invention to provide an improved passive emergency egress pathway marking system.

It is another object of the invention to provide a larger area for charging than in conventional strip systems. The increased area afforded by a fully carpeted pathway would be more forgiving to the specific location(s) of ambient lighting and less susceptible to the detrimental effects of occasional obstructions.

It is another object of the invention to provide a passive emergency egress system utilizing photoluminescent material, which provides an increased luminous flux in relation to the thin parallel photoluminescent strips conventionally known and used in the art.

It is another object of the present invention to provide a means for communicating directional, locational, or other information to occupants during an emergency, activation of which is automatic, being an integral part of the passive marking system.

Other objects and advantages of the invention will be more fully appreciated with reference to the ensuing disclosure and appended claims.

SUMMARY OF THE INVENTION

The present invention relates in one aspect thereof to an emergency egress system that comprises a fiber (yarn) containing photoluminescent material.

In one embodiment, the emergency egress system comprises the use of this yarn in a woven carpet or other fibrous web structure, e.g., in a photoluminescent carpet in the aisles of aircraft, to define the emergency egress marking system. In this manner, the entire area extent (length and width) of the egress path may be covered with the photoluminescent covering, so that the egress path is strongly visually discernible when ambient light exposure is diminished or discontinued.

Illumination of the egress pathway will therefore occur essentially uniformly across the extent of the entire aisle upon the removal of ambient light. This aspect of the present invention overcomes the inherent disadvantages of narrow-dimension photoluminescent strips, as are currently used to illuminate parallel lines along the aisle, at its margins.

Within the carpet, photoluminescent material preferably is woven homogeneously through the carpet body, so that photoluminescence is uniformly achieved across substantially the entire surface area of the aisle.

The luminous flux of the woven carpet comprising photoluminescent fibers is thus greater than that of photoluminescent strips, which provide only a long narrow region of photoluminescence.

Further, as luminous intensity decreases with time following the removal of ambient light, the emergency egress pathway marking system of the present invention will continue to provide usable egress pathway demarcation information, as illumination of the entire exit aisle is more conspicuous than illumination of only two parallel strips, at any given level of intensity.

The weaving of photoluminescent fiber into the exit aisle carpet also may be carried out to allow the inclusion of important directional and locational information that can assist passengers during emergency.

For example, in one aspect of the present invention, the photoluminescent fibers are selectively woven into the carpet so as to form informational icons, such as directional arrows, pictograms, or text, when the photoluminescent fibers become the dominant light source upon the removal of ambient light. Thus, the informational icons begin to perceptually "glow" (luminesce) automatically upon the failure of the aircraft cabin ambient lighting system.

These informational icons can be quite large in extent, i.e., as wide as the aisle, and several meters or more in length. The icons may be of a visually simple form, such as directional arrows guiding passengers in the proper direction down the aisle to access to the nearest emergency exit.

Alternatively, or additionally, informational icons of such type can be deployed to point out important locational information, such as the location of fire extinguishers, life rafts, first-aid kits, communications terminals, or other emergency equipment. These informational icons could be formed in the text of any written language(s), or alternatively may be multi-lingual in character.

Alternatively, or additionally, the informational icons may include any of the international standard pictograms, which convey information entirely through outline/area, and do not rely on color or text.

Any of the aforementioned informational icons may be formed in a "positive" or "negative" manner, i.e., the icon can be defined by the presence of photoluminescent fibers against a background void of photoluminescence, or the icon can be defined by the absence of photoluminescence against a background containing the photoluminescent fibers.

In another aspect of the present invention, informational icons, such as directional arrows, are formed in the emergency egress pathway at the time of installation, by integration of photoluminescent and non-photoluminescent carpet sections or pieces. This technique has the advantage of simplifying the requisite carpet manufacturing process. In this aspect, weaving the photoluminescent fiber into the carpet in an essentially uniform manner would form the photoluminescent carpet. The photoluminescent carpet and non-photoluminescent carpet would be installed contemporaneously, with information icons produced by cutting and fitting together the two types of carpet to form the desired pattern or iconic graphic design, e.g., directional arrows.

In another aspect of the present invention, a set of modular carpet squares is fabricated, with a specific type of informational icon or design formed in each distinct type of carpet square, by selective weaving of photoluminescent fibers into the carpet to yield such specific type of informational icon or design. Upon installation, a desired configuration of the emergency egress pathway marking system can be assembled by appropriate selection and arrangement of the respective types of modular carpet squares.

This embodiment of the invention strikes a balance between the cost of manufacturing the aircraft aisle carpet with photoluminescent informational icons formed integrally therein, and the cost of installation whereby the icons are formed through cutting and fitting together of photoluminescent and non-photoluminescent carpet. A set of modular carpet squares with photoluminescent informational icons can be produced in bulk, and quickly and easily installed or retrofitted, to selectively form a wide variety of informational icons, with concomitant savings in manufacturing costs over the manufacture of full "custom" photoluminescent aisle carpet, and concomitant savings in installation costs over a "custom" egress pathway marking system formed by cutting and fitting together the two carpet types (photoluminescent and non-photoluminescent).

In yet another aspect of the present invention, two discrete types of modular carpet squares are provided: one type containing photoluminescent fibers and another type that is devoid of photoluminescent fibers. Within those modular carpet squares containing photoluminescent fibers, the fibers arc woven into the carpet in a substantially uniform manner. Upon installation, the emergency egress pathway is thus defined, e.g., by installing the photoluminescent carpet squares across the full width of the aisle, or alternatively down the center of the aisle, or alternatively in parallel lines along either side of the aisle, and installing non-photoluminescent carpet elsewhere.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
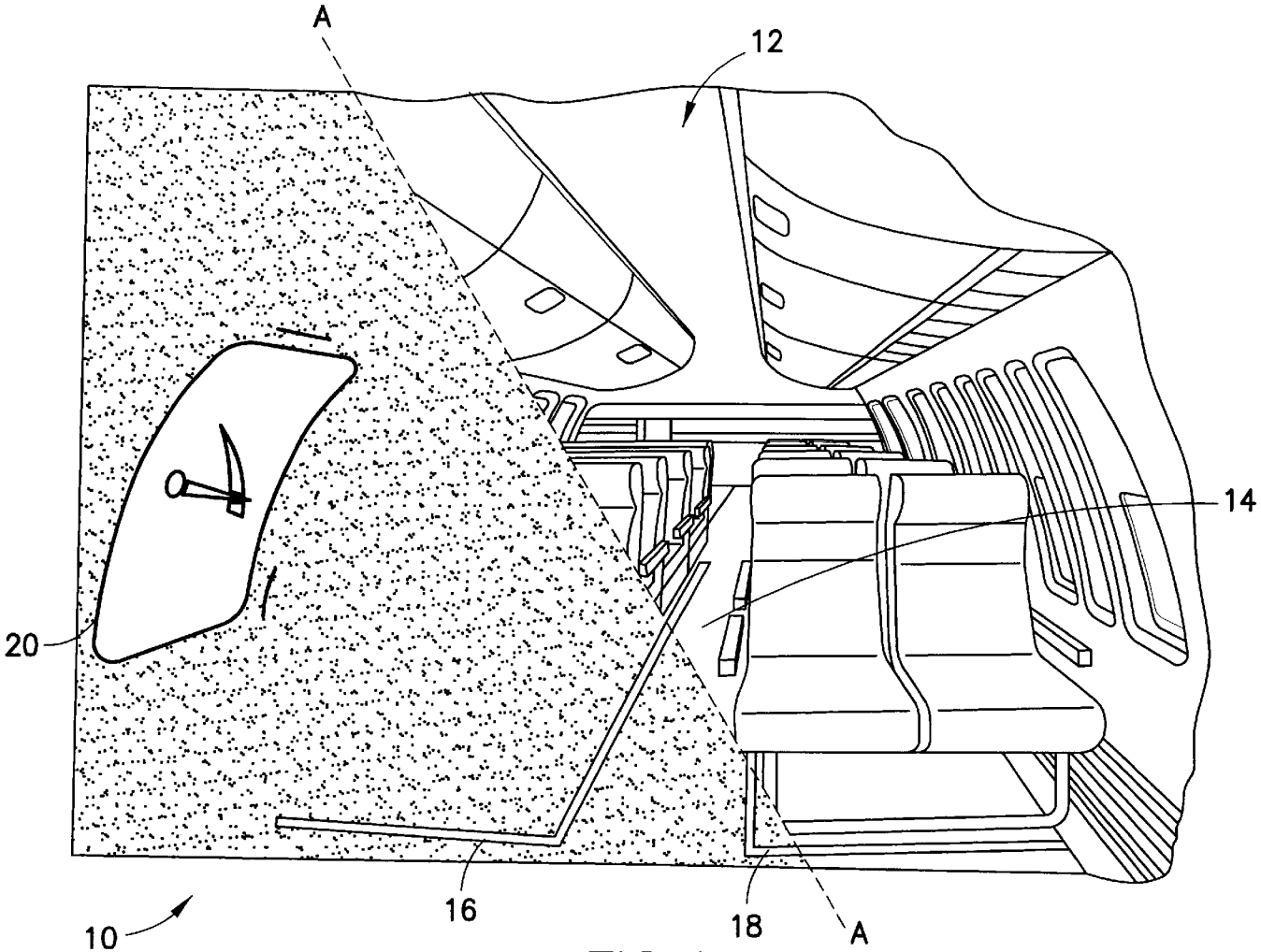
FIG. 1 PRIOR ART
FIG. 1 depicts an aircraft photoluminescent strip pathway marking system of the prior art.

The present invention, while hereinafter primarily described in reference to use of photoluminescent carpeting for emergency egress systems in aircraft, is not thus limited, and may be applied to or embodied in other systems or usage. For example, the photoluminescent carpeting may be employed for other vehicular or motive structures, e.g., buses, trains, subway cars, so-called "people movers" used for mass transportation in airport and stadium facilities, as well as in buildings or other fixed or stationary structures, or semi-permanent structures, such as tents for circus and other entertainment events, to name but a few specific and illustrative examples.

The present invention is based on the discovery that photoluminescent carpeting may be easily and efficiently employed to form an emergency egress system overcoming the deficiencies of the prior art passive emergency egress systems.

The photoluminescent carpeting of the invention may be in the form of a woven or non-woven web material having photoluminescent fibers integrally incorporated therein as a structural component of the carpeting. Preferably, the carpeting is woven. The carpeting may be of any suitable type or grade appropriate to the end use of the emergency egress system, e.g., comprising fibers of wool, cotton, linen, polyester, polyurethane, nylon, acrylic or other natural or synthetic fibers, or blends or composites of such fibers.

The carpeting has incorporated therein photoluminescent fibers in sufficient number and density to provide the desired photoluminescent effect under use conditions, as may be readily determined without undue effort by specific empirical testing of carpeting at differing densities of the specific photoluminescent fibers employed, and determination of the resultant luminescence achieved when the carpeting is exposed to ambient light and then subjected to dark conditions.

The photoluminescent fibers may be of any suitable type, and may comprise for example a glass, polymeric or natural fiber that is intrinsically or has been rendered photoluminescent in character.

For example, the fiber may be formed from a polymeric melt by conventional spinning or drawing techniques, wherein the polymeric melt comprises a photoluminescent material, such as the photoluminescent complexes described in Gravisse, et al. U.S. Pat. No. 4,211,813, comprising one or more phosphorescent metal sulfides such as zinc sulfide or calcium sulfide, in combination with one or more compounds that absorb energy of short wave-length and emit it at wave-lengths which lie within the absorption spectrum of the phosphorescent constituent or constituents of the composition, such as an aromatic hydrocarbon, e.g., diphenyloxazole, 2,5-diphenylfurane, para-phenylene-2,2'-bis(phenyl-5-oxazole) or its dimethyl derivative, di-(3-ethylheptyl)-para-quinquephenyl, etc.

Alternatively, a photoluminescent fiber of the type disclosed by Geisel, U.S. Pat. No. 5,674,437, or the prior art references discussed therein, may be used. Geisel discloses a method of combining a metal aluminate oxide pigment with a thermoplastic polymer, and then heating, mixing, and extruding the combination into a fiber.

Another suitable photoluminescent fiber may be formed by the process disclosed by Schloss in U.S. Pat. No. 5,914,076, for producing longer-lasting, high luminescence, phosphorescent textile fibers. This process comprises blending Aluminum Oxide C with metal oxide phosphor particles, sifting the blended particles, and introducing them into a thermoplastic polymer carrier resin during the melt-stage of an extrusion and pelletizing process, to form pellets that are fed into a melt extrusion unit to form multi-filament phosphorescent textile yarn.

Optionally, the photoluminescent composition may include one or more fluorescent substances having an emission spectrum located towards the longer wave-lengths within or outside the absorption/emission spectrum of the phosphorescent material or materials, e.g., rhodamine B, fluorescein or uranine S. The function of such fluorescent substances is to give the article a daytime (illuminated) coloration different from its nighttime (dark) coloration.

The photoluminescent material may for example comprise diphenyloxazole, zinc sulfide and a fluorescent substance that emits light at wavelengths of from 5500 to 7500 Angstroms. Such photoluminescent material may be incorporated in the polymeric melt or monomer formulation that is used to produce synthetic fibers, or coated on natural fibers by tow dipping of fibers or conventional spindle dyeing processes.

Referring now to the drawings, FIG. 1 depicts an aircraft photoluminescent strip pathway marking system 10 of the prior art, disposed in an aircraft cabin 12. As illustrated, the cabin 12 is demarcated into a lighted zone to the right of dashed line A—A and a dark zone to the left of such demarcation line, for ease of reference. The aisle 14 is bordered at its margins by conventional electroluminescent strip lighting elements 16 and 18 constituting the marking system 10, and leading to the egress door 20. The egress door in turn may be bordered by reflective tape or photoluminescent material.

Figure 2:
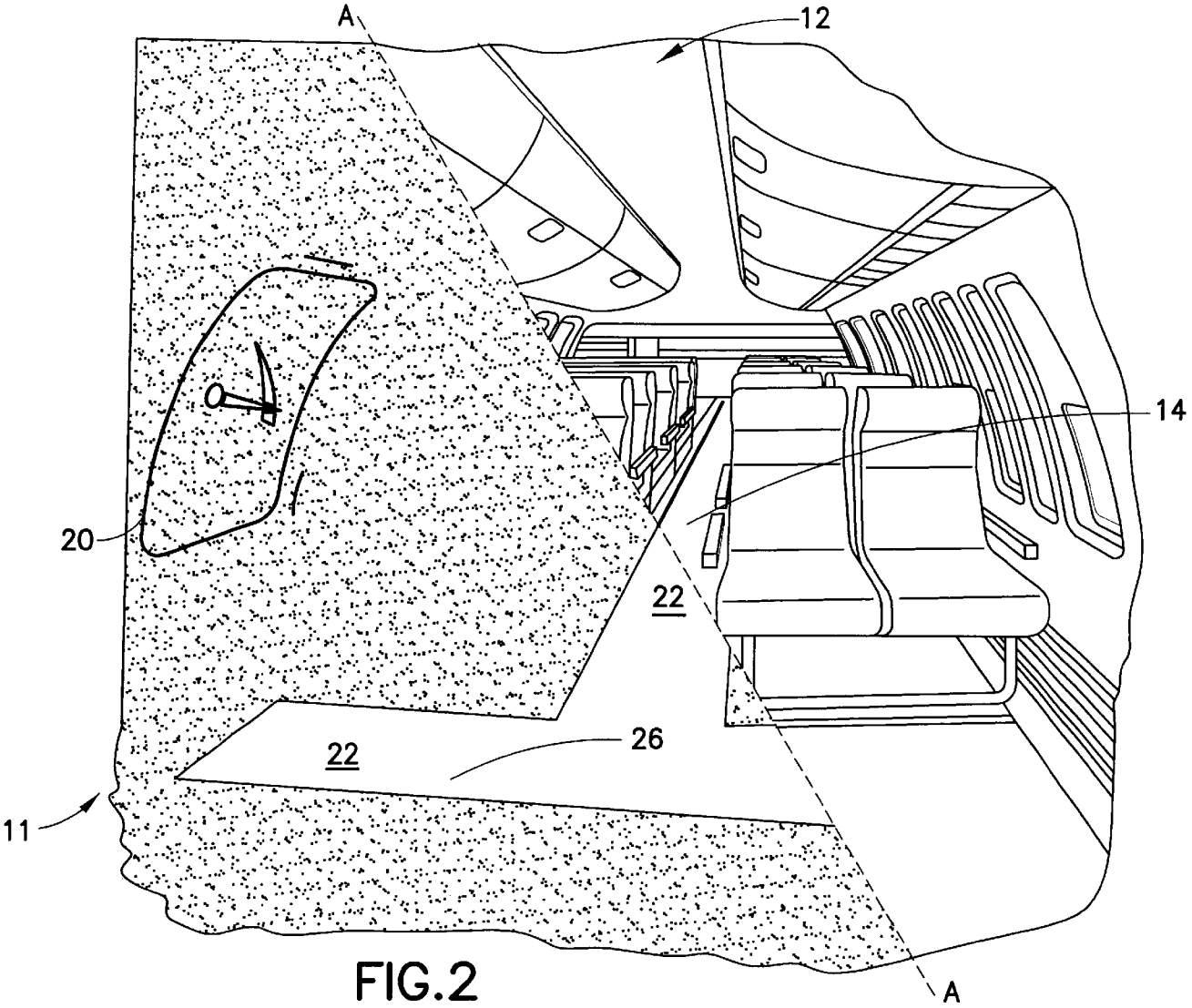
FIG. 2 depicts an aircraft photoluminescent carpet pathway marking system according to one embodiment of the present invention.
Figure 3:
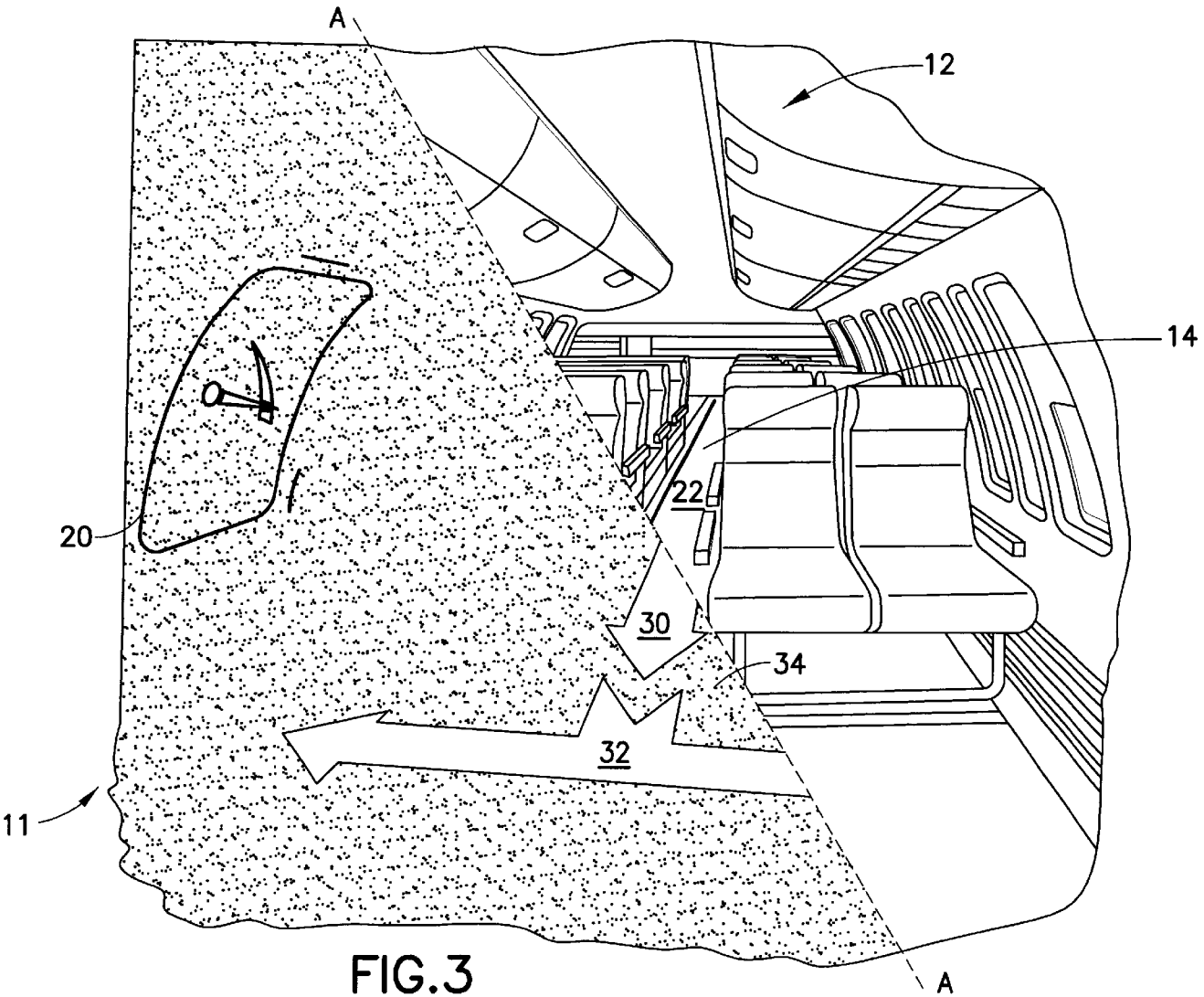
FIG. 3 depicts an aircraft photoluminescent carpet pathway marking system, employing directional informational icons according to another embodiment of the present invention.

FIGS. 2 and 3 showing illustrative embodiments of the present invention are correspondingly numbered with reference to FIG. 1, for ease of reference and description.

FIG. 2 depicts an aircraft photoluminescent carpet pathway marking system 11 according to one embodiment of the present invention, comprising a photoluminescent carpet 22 in the aisle 14 and the transverse walkway 26 of the cabin 12. The carpet 22 provides a photoluminescently-illuminated path across the full area extent of the aisle and transverse walkway, as shown.

FIG. 3 depicts an aircraft photoluminescent carpet pathway marking system 11, employing photoluminescent directional informational icons 30 and 32 in the carpet 22, according to another embodiment of the present invention. The photoluminescent informational icons 30 and 32 as shown are provided in the carpeted field, as component regions thereof, and the carpeted field also includes non-photoluminescent portions 34 of the carpet 22, whereby the photoluminescent and non-photoluminescent portions of the carpet corporately define the iconic structure which serves to guide persons along the path of egress, down the aisle and to the egress door 20.

FIGS. 4A–4D depict modular carpet squares, with photoluminescent information icons formed therein, as representative examples of one embodiment of the present invention.

Figure 4A:
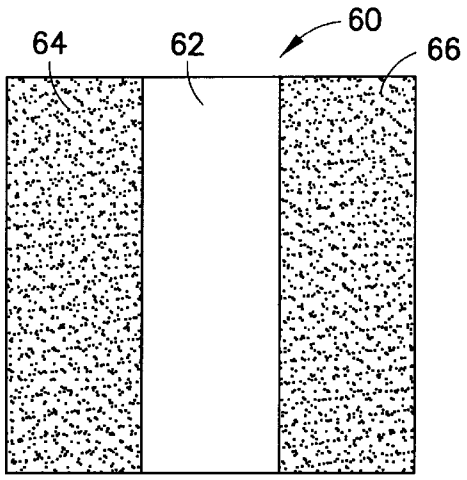
FIGS. 4A–4D depict modular carpet squares, with photoluminescent information icons formed therein, as representative examples of one embodiment of the present invention.

FIG. 4A shows a carpet section 60 comprising a central or medial strip 62 of photoluminescent carpet and marginal portions 64 and 66 of non-photoluminescent carpet.

Figure 4B:
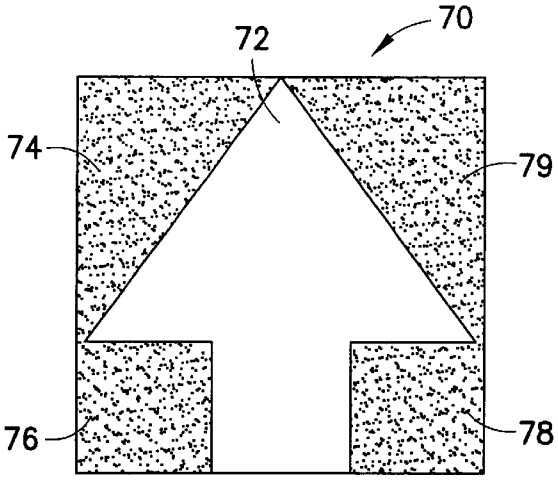

FIG. 4B shows a carpet section 70 comprising an arrow-shaped portion 72 of photoluminescent carpet and surrounding portions 74, 76, 78 and 79 of non-photoluminescent carpet.

Figure 4C:
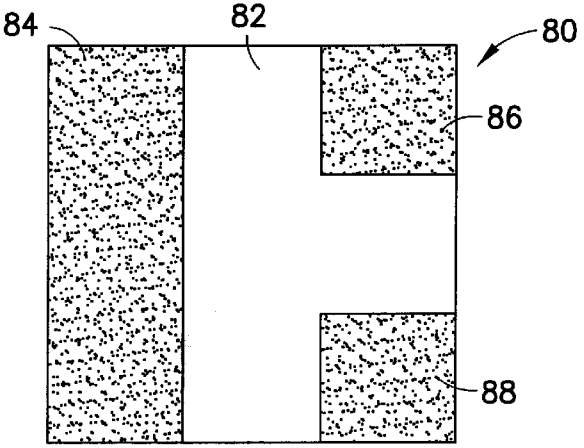

FIG. 4C shows a carpet section 80 comprising a sideways "T"-shaped portion 82 of photoluminescent carpet and surrounding portions 84, 86 and 88 of non-photoluminescent carpet.

Figure 4D:
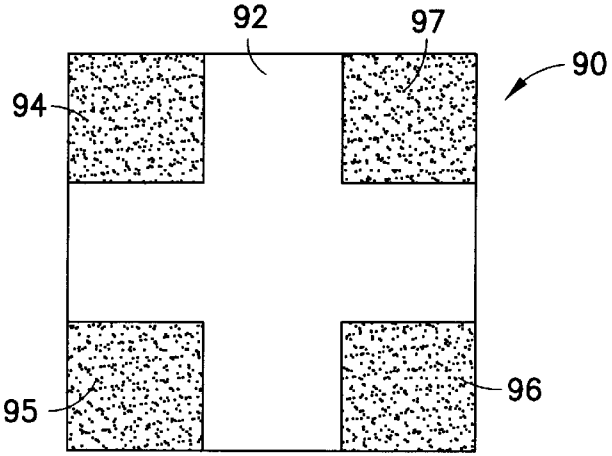

FIG. 4D shows a carpet section 90 comprising a cruciform-shaped portion 92 of photoluminescent carpet and surrounding corner portions 94, 95, 96 and 97 of non-photoluminescent carpet.

It will be apparent from visual inspection of the FIGS. 4A–4D carpet sections that they may be arranged in various patterns by selective contiguous placement of two or more sections so that a directional or locational indicia of photoluminescent character is provide in the resultant consolidated carpet. It will be correspondingly apparent that a kit or assembly of sections of such general type may be provided, so that the installer or egress system designer can selectively match sections of various types to form a wide variety of patterns for formation of photoluminescent carpet egress systems in accordance with the present invention.

The features and advantages of the present invention are more fully shown with reference to the following illustrative example. While this example demonstrates the efficacy of the present invention, it is understood that both the density of photoluminescent material in the yarn, and the relative density of photoluminescent yarn compared with other fibers woven into the carpet, may be varied considerably within the broad practice of the present invention, as required for a specific application.

EXAMPLE

Illumination energy and rate of decay of illumination for a photoluminescent carpet yarn was tested.

A photoluminescent carpet yarn sample was manufactured by Shaw Industries of Dalton, Ga., incorporating photoluminescent fiber woven substantially uniformly throughout the sample. The sample was "dark adapted" (isolated from light) for 16 hours. The sample then was exposed to 40 Lux of luminous energy from a fluorescent light source for 30 minutes, following which the light source was removed and a PR1530 instrument was used to measure the luminance of the sample at 10-minute intervals. A plot of the resultant data is set out in FIG. 5.

Figure 5:
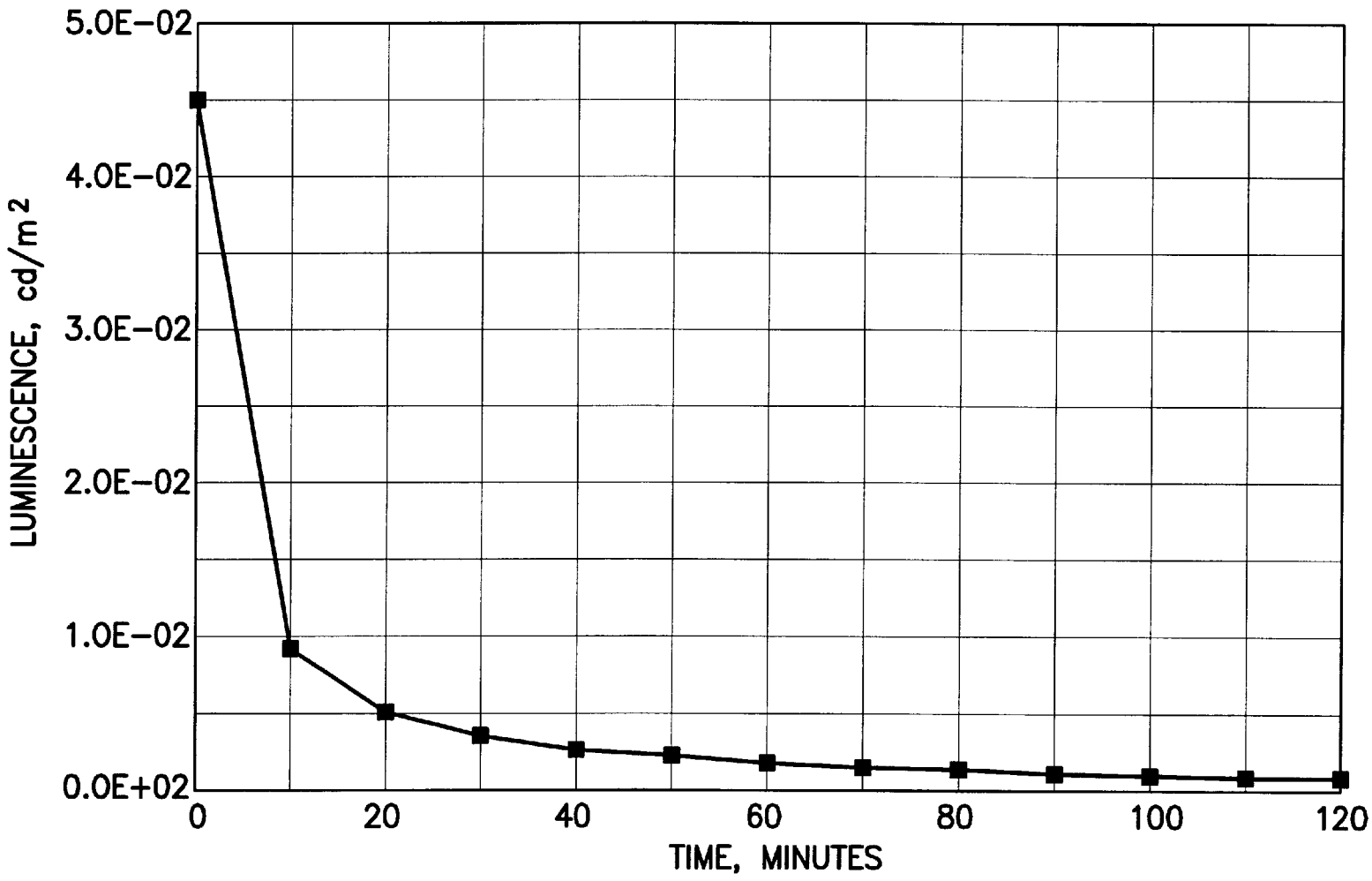
FIG. 5 is a graph depicting the luminance decay emanating from a photoluminescent carpet fiber following the removal of a specific light source.

FIG. 5 depicts the intensity and decay of luminous energy emanating from the above-described photoluminescent yarn, measured in luminescence (luminance) units of $10^{-3}$ cd/m$^2$ as a function of time in minutes.

As shown by the FIG. 5 graph, during the period of 0 to 10 minutes, there is a steady diminution of light emission, with the luminance thereafter remaining above $2\times10^{-3}$ cd/m$^2$ until 60 minutes total time has elapsed. The luminance intensity from 0 to 60 minutes provides sufficient lighting of an extended area egress path, for aiding and luminatively guiding exit of personnel from an aircraft cabin or other locus equipped with such photoluminescent carpet.

While the invention has been described herein with reference to specific features and illustrative embodiments, it will be recognized that the utility of the invention is not thus limited, but rather extends to and encompasses other features, modifications and alternative embodiments as will readily suggest themselves to those of ordinary skill in the art based on the disclosure and illustrative teachings herein. The claims that follow are therefore to be construed and interpreted as including all such features, modifications and alternative embodiments within their spirit and scope.

What is claimed is:

1. An emergency egress system for a locus that is exposed to light in non-emergency use and susceptible to interruption or termination of light in emergency circumstances, said emergency egress system comprising a fibrous web deployed in said locus, wherein the fibrous web has photoluminescent fiber incorporated therein in sufficient amount and distribution to illuminate the web or predetermined portions thereof during said interruption or termination of light in emergency circumstances, and subsequent to light exposure thereof.

2. The emergency egress system of claim 1, wherein the fibrous web comprises a woven carpet.

3. The emergency egress system of claim 1, wherein the locus comprises a structurally confined space.

4. The emergency egress system of claim 1, wherein the locus comprises an aircraft passenger compartment.

5. The emergency egress system of claim 1, wherein the locus comprises an aircraft passenger compartment, and the fibrous web comprises a woven carpet in an aisle or other walkway of the passenger compartment.

6. The emergency egress system of claim 5, wherein the woven carpet is photoluminescent across its full dimensional extent.

7. The emergency egress system of claim 5, wherein the woven carpet is photoluminescent in predetermined regions thereof to define indicia aiding persons viewing same in said emergency circumstances.

8. The emergency egress system of claim 7, wherein said indicia are directionally indicative of a path to an exit from the locus.

9. The emergency egress system of claim 7, wherein said indicia demarcate a path to an exit from the locus.

10. The emergency egress system of claim 1, wherein photoluminescent fiber is woven homogeneously through the fibrous web, so that correspondingly uniform photoluminescence is achieved across the dimensional extent of the fibrous web.

11. The emergency egress system of claim 1, wherein said photoluminescent fiber incorporates a photoluminescent composition comprising one or more phosphorescent metal sulfides, and one or more compounds that absorb energy of short wave-length and emit it at wave-lengths which lie within the absorption spectrum of the phosphorescent metal sulfide(s).

12. The emergency egress system of claim 11, wherein the phosphorescent metal sulfide(s) comprise a metal sulfide selected from the group consisting of zinc sulfide and calcium sulfide.

13. The emergency egress system of claim 11, wherein said compound(s) that absorb energy of short wave-length and emit it at wave-lengths which lie within the absorption spectrum of the phosphorescent metal sulfide(s) comprise an aromatic hydrocarbon.

14. The emergency egress system of claim 11, wherein said aromatic hydrocarbon is selected from the group consisting of diphenyloxazole, 2,5-diphenylfurane, paraphenylene-2,2'-bis(phenyl-5-oxazole), dimethyl paraphenylene-2,2'-bis(phenyl-5-oxazole), and di-(3-ethylheptyl)-para-quinquephenyl.

15. A kit comprising a multiplicity of different type carpet sections, for assembly of a carpet therefrom, wherein at least one of the different types of carpet sections comprises photoluminescent fiber incorporated therein in sufficient amount and distribution provide illumination during interruption or termination of light exposure, and assembly of the different type carpet sections produces a carpet having photoluminescent and non-photoluminescent regions.

16. The kit of claim 15, wherein the carpet under a dark condition following exposure to light exhibits a photoluminescent pattern.

17. The kit of claim 15, wherein said multiplicity of different type carpet sections includes carpet sections that are photoluminescent across the full area extent thereof, and other carpet sections that are non-photoluminescent.

18. The kit of claim 15, wherein said multiplicity of different type carpet sections includes carpet section types that are differently photoluminescently patterned.

19. A method of providing assisted egress from a locus that is exposed to light in nonemergency use and susceptible to interruption or termination of light in emergency circumstances, said method comprising providing in said locus an emergency egress system comprising a fibrous web, wherein the fibrous web has photoluminescent fiber incorporated therein in sufficient amount and distribution to illuminate the web or predetermined portions thereof during said interruption or termination of light in emergency circumstances, and subsequent to light exposure thereof, whereby said illuminated web or portions thereof aid persons viewing same in said emergency circumstances to visually determine a path to an exit from said locus.

* * * * *

UNITED STATES PATENT AND TRADEMARK OFFICE

CERTIFICATE OF CORRECTION

PATENT NO. : 6,307,207 B1
DATED : October 23, 2001
INVENTOR(S) : Robert M. Burbank It is certified that error appears in the above-identified patent and that said Letters Patent is hereby corrected as shown below:

Column 2,
Line 15, "material s" should be -- materials --
Line 21, "path w ay" should be -- pathway --
Line 31, "s trips" should be -- strips --

Signed and Sealed this

Twenty-sixth Day of March, 2002

*Attest:*

*Attesting Officer*

JAMES E. ROGAN
*Director of the United States Patent and Trademark Office*